US011078677B2

(12) United States Patent
Radke

(10) Patent No.: US 11,078,677 B2
(45) Date of Patent: Aug. 3, 2021

(54) INTERLOCKING JACKET AND METHOD FOR USING THE SAME TO JACKET A CONCRETE STRUCTURE

(71) Applicant: George Radke, Delta (CA)

(72) Inventor: George Radke, Delta (CA)

( * ) Notice: Subject to any disclaimer, the term of this patent is extended or adjusted under 35 U.S.C. 154(b) by 0 days.

(21) Appl. No.: 16/838,470

(22) Filed: Apr. 2, 2020

(65) Prior Publication Data

US 2021/0017779 A1 Jan. 21, 2021

(51) Int. Cl.

| | |
|---|---|
| ***E04B 1/00*** | (2006.01) |
| ***E04G 23/02*** | (2006.01) |
| ***E04C 5/07*** | (2006.01) |
| ***E04B 1/98*** | (2006.01) |

(52) U.S. Cl.

CPC ..... *E04G 23/0218* (2013.01); *E04B 1/98* (2013.01); *E04C 5/07* (2013.01)

(58) Field of Classification Search

None

See application file for complete search history.

(56) References Cited

U.S. PATENT DOCUMENTS 824,513 A * 6/1906 Stevens ..... E02D 5/08 405/279
1,075,153 A * 10/1913 Klotz ..... F24F 13/0209 138/163
1,571,412 A * 2/1926 Irvin ..... B21C 37/101 228/117
3,154,037 A * 10/1964 Mayrath ..... B21C 37/101 72/52
3,222,841 A * 12/1965 Lipof ..... E06B 9/52 52/482
3,968,561 A * 7/1976 Oakes ..... E06B 3/2675 29/460
4,216,634 A * 8/1980 Binder ..... E04C 3/36 264/46.6
4,598,512 A * 7/1986 Chapman ..... E04H 12/2292 52/165
4,632,602 A * 12/1986 Hovnanian ..... B09B 1/00 405/129.8
4,759,159 A * 7/1988 Blazley ..... E04B 7/08 52/86
4,987,717 A * 1/1991 Dameron, Jr. ..... E04B 7/00 52/11
5,514,432 A * 5/1996 Lisec ..... E06B 3/66314 248/208
5,584,610 A * 12/1996 Simpson ..... E02D 5/00 405/248
5,791,115 A * 8/1998 Nicolai ..... H02B 1/01 52/836
6,000,883 A * 12/1999 Irvine ..... E02D 5/02 405/274
6,014,988 A * 1/2000 Gagnon ..... B01D 29/111 138/168

(Continued)

*Primary Examiner* — Basil S Katcheves
(74) *Attorney, Agent, or Firm* — Nexus Law Group LLP

(57) ABSTRACT

An interlocking jacket and method for using the same is provided to jacket a concrete structure. The jacket may include a first planar member and a second planar member connected at a right angle. A first hook may be connected to the first planar member and a second hook may be to the second planar member with the hook of one jacket operable to engage the hook of a second jacket when used to jacket a concrete structure.

8 Claims, 10 Drawing Sheets

(56) References Cited

U.S. PATENT DOCUMENTS

| | | | | |
|---|---|---|---|---|
| 7,168,220 | B2 * | 1/2007 | Owoc | B29C 63/18 52/844 |
| D538,948 | S * | 3/2007 | Thimons | D25/119 |
| 7,257,932 | B2 * | 8/2007 | Ng | E04C 3/07 138/168 |
| 7,607,276 | B2 * | 10/2009 | Gordin | E04H 12/2292 52/170 |
| 9,032,694 | B2 * | 5/2015 | Bernard | E04H 12/2292 52/844 |
| 9,771,734 | B2 * | 9/2017 | Odegard | E04H 12/2292 |
| D837,043 | S * | 1/2019 | Rehhahn | D8/382 |
| 10,597,893 | B2 * | 3/2020 | Tersigni | E04H 12/2292 |
| 2003/0126827 | A1 * | 7/2003 | Davis | E04C 3/07 52/843 |
| 2005/0271467 | A1 * | 12/2005 | Ong | E04C 3/32 403/359.1 |
| 2012/0131864 | A1 * | 5/2012 | Blaylock | E04H 12/2292 52/170 |

* cited by examiner

INTERLOCKING JACKET AND METHOD FOR USING THE SAME TO JACKET A CONCRETE STRUCTURE

FIELD OF THE INVENTION

The invention relates to the field of building reinforcement structures and particularly, to an interlocking jacket for concrete columns and method of using the same.

BACKGROUND OF THE INVENTION

All around the Pacific Rim there are cities such as Los Angeles, San Francisco, Tokyo, and Vancouver that are built on, or near major earthquake producing fault lines. Many of these cities have high-rise office and condo buildings that are each supported by hundreds of reinforced concrete columns. It is these concrete columns supporting these buildings that the present invention is designed to protect.

For example, several concrete support columns fractured and crumbled as a result of the 2015. Chilean earthquake. Upon further review, it was determined that the reinforcing rebar used in the columns were unable to contain the concrete in the columns and consequently, several buildings failed. The columns would have retained their compression strength even if they were fractured had the columns been contained or reinforced. Containing or reinforcing concrete columns would have saved the buildings from collapse.

Accordingly, a need exists for a concrete jacketing apparatus to prevent columns failures. Other objects of the invention will be apparent from the description that follows.

SUMMARY OF THE INVENTION

The invention relates to two identical stainless steel sheet forms engineered to lock together around existing concrete columns enclosing them from floor to ceiling. With the many fixtures and fittings mounted on these columns, the invention can be fitted from back to front or from side to side. Under seismic activity the two interlocking seams tighten forever, preventing the fractured concrete column from losing compression strength and therefore maintaining its integrity.

There are no mechanical fasteners holding the invention together. The two ten-gauge stainless steel sheet forms are manufactured to tightly fit each column. The two matching seams slide together locking each form around the column. Under seismic activity, they provide a secure lock.

The invention includes identical sheets of stainless steel which surrounds with interlocking seams for enclosing existing concrete columns from floor to ceiling.

According to the present invention there is provided an interlocking jacket. The jacket may include a first planar member having first and second sides, top and bottom sides and first and second opposed faces. A second planar member may also be included and may also have first and second sides, top and bottom sides and first and second opposed faces. The first side of the second planar member may be connected to the first side of the first planar member wherein the first and second planar members form substantially a right angle with the first faces forming an inside angle of the right angle. The first and second planar members may be rectangular planar members. The second planar member may be connected to the first planar member along substantially a length of the first sides.

The jacket may also include a first hook connected substantially in-line with the first planar member at the second side of the first planar member. The first hook may have a hooking portion substantially parallel with the first planar member and may extend along the second face of the first planar member.

The jacket may also include a second hook connected substantially at a right angle with the second planar member at the second side of the second planar member.

The second hook may have a hooking portion substantially parallel with the first planar member and may extend towards the first face of the second planar member.

The hook of the first planar member may run substantially a length of the second side of the first planar member whereas the hook of the second planar member may run substantially a length of the second side of the second planar member. The ends of the hooking portions may each comprise a beveled edge at substantially an identical angle, for example, 45°.

The first and second planar members and hooks may be integrally formed. Indeed, the first and second planar members and hooks may be integrally formed from a substantially rigid material or they may be integrally formed from substantially a rigid yet flexible material.

In according with another embodiments of the invention there is provided a method of jacketing a structure. The method may include providing a first interlocking jacket which may include a first planar member having first and second sides, top and bottom sides and first and second opposed faces. A second planar member may also be included and may also have first and second sides, top and bottom sides and first and second opposed faces. The first side of the second planar member may be connected to the first side of the first planar member wherein the first and second planar members form substantially a right angle with the first faces forming an inside angle of the right angle. The first and second planar members may be rectangular planar members. The second planar member may be connected to the first planar member along substantially a length of the first sides.

The jacket may also include a first hook connected substantially in-line with the first planar member at the second side of the first planar member. The first hook may have a hooking portion substantially parallel with the first planar member and may extend along the second face of the first planar member. The jacket may also include a second hook connected substantially at a right angle with the second planar member at the second side of the second planar member. The second hook may have a hooking portion substantially parallel with the first planar member and may extend towards the first face of the second planar member.

The method may further include engaging the first interlocking jacket around the structure and providing a second interlocking jacket which may also include a first planar member having first and second sides, top and bottom sides and first and second opposed faces. A second planar member may also be included and may also have first and second sides, top and bottom sides and first and second opposed faces. The first side of the second planar member may be connected to the first side of the first planar member wherein the first and second planar members form substantially a right angle with the first faces forming an inside angle of the right angle. The first and second planar members may be rectangular planar members. The second planar member may be connected to the first planar member along substantially a length of the first sides. The jacket may also include a first hook connected substantially in-line with the first planar member at the second side of the first planar member. The first hook may have a hooking portion substantially parallel with the first planar member and may extend along the second face of the first planar member. The jacket may also include a second hook connected substantially at a right angle with the second planar member at the second side of the second planar member. The second hook may have a hooking portion substantially parallel with the first planar member and may extend towards the first face of the second planar member.

The method may further include rotating the second interlocking jacket 180° on an axis with respect to said first interlocking jacket and slidably engaging the second jacket to the structure and with the first interlocking jacket wherein the first hook of the first interlocking jacket engages with the second hook of the second interlocking jacket and wherein the second hook of the first interlocking jacket engages with the first hook of the second interlocking jacket. The second interlocking jacket may be horizontally engaged to the structure and with the first interlocking jacket.

The method may further include providing a beveled edge to each end of the hooking portions wherein slidably engaging the second interlocking jacket to the structure and with the first interlocking jacket comprises engaging the hooks with one-another along the beveled edges.

In accordance with yet another embodiment of the present invention there is provided an interlocking jacket. The jacket may include a curved planar member having first and second sides, top and bottom sides and first and second opposed faces. The jacket may also include a first hook connected substantially in-line with the first side, the first hook having a hooking portion substantially parallel with the first side and extending along the second face of the curved planar member. The jacket may also include a second hook connected substantially in-line with the second side, the second hook having a hooking portion substantially parallel with the second side and extending along the first face of said curved planar member.

The first hook may run substantially a length of the first side of the curved planar member whereas the second hook may run substantially a length of the second side of the curved planar member. The ends of the hooking portions may each comprise a beveled edge at substantially an identical angle, for example, 45°.

The curved planar member and hooks may be integrally formed. Indeed, the curved planar member and hooks may be integrally formed from a substantially a rigid material or they may be integrally formed from substantially a rigid yet flexible material.

In accordance with another embodiments of the invention there is provided a method of jacketing a structure. The method may include providing a first interlocking jacket which may include a curved planar member having first and second sides, top and bottom sides and first and second opposed faces. The jacket may also include a first hook connected substantially in-line with the first side, the first hook having a hooking portion substantially parallel with the first side and extending along the second face of the curved planar member. The jacket may also include a second hook connected substantially in-line with the second side, the second hook having a hooking portion substantially parallel with the second side and extending along the first face of the curved planar member.

The method may further include engaging the first interlocking jacket around the structure and providing a second interlocking jacket which may also include a curved planar member having first and second sides, top and bottom sides and first and second opposed faces. The jacket may also include a first hook connected substantially in-line with the first side, the first hook having a hooking portion substantially parallel with the first side and extending along the second face of the curved planar member. The jacket may also include a second hook connected substantially in-line with the second side, the second hook having a hooking portion substantially parallel with the second side and extending along the first face of the curved planar member.

The method may further include rotating the second interlocking jacket 180° on an axis with respect to said first interlocking jacket and slidably engaging the second jacket to the structure and with the first interlocking jacket wherein the first hook of the first interlocking jacket engages with the second hook of the second interlocking jacket and wherein the second hook of the first interlocking jacket engages with the first hook of the second interlocking jacket. The second interlocking jacket may be horizontally engaged to the structure and with the first interlocking jacket.

The method may further include providing a beveled edge to each end of the hooking portions wherein slidably engaging the second interlocking jacket to the structure and with the first interlocking jacket comprises engaging the hooks with one-another along the beveled edges.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 11:
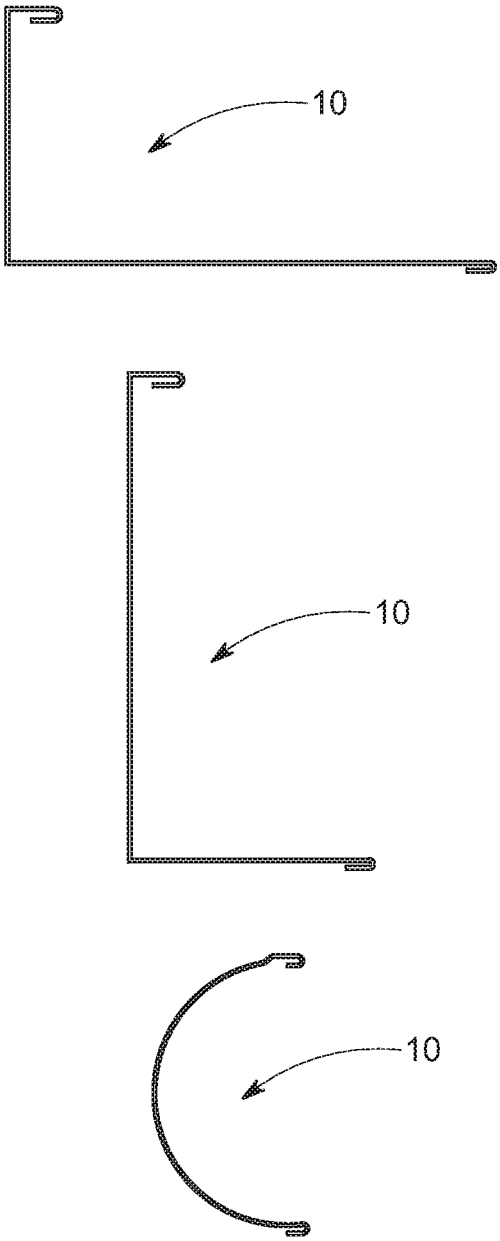
FIG. 11 is a top plan view of all three embodiments of the interlocking jacket.
Figure 12:
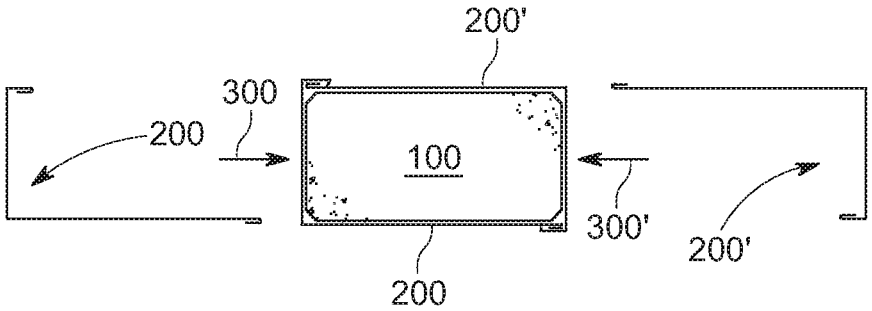
FIG. 12 is a top plan view of the first embodiment of the interlocking jacket with two jackets external to a rectangular concrete column in a first position and the two jackets wrapped around the rectangular concrete column in a second position.
Figure 13:
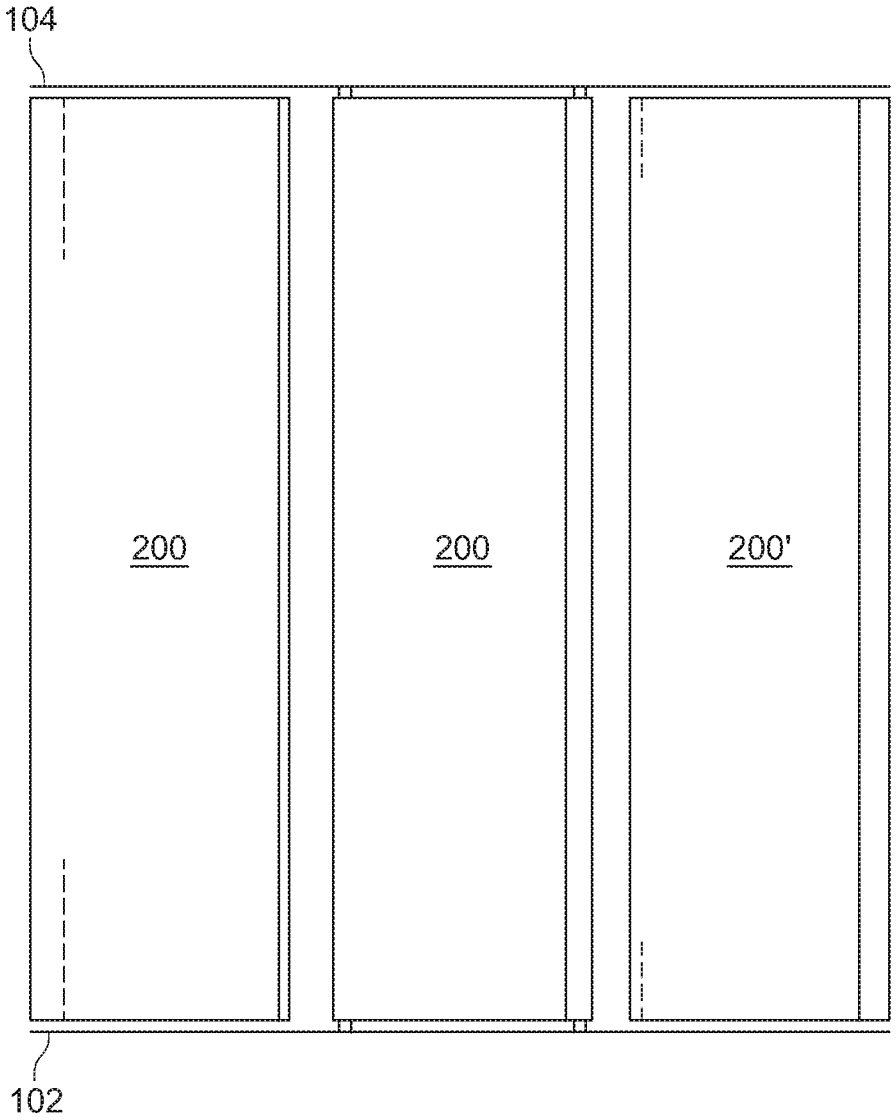
FIG. 13 is a side view of the first embodiment of the interlocking jacket with two jackets external to a rectangular concrete column in a first position and the two jackets wrapped around the rectangular concrete column in a second position.
Figure 14:
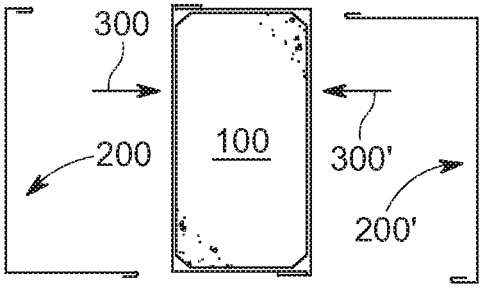
FIG. 14 is a top plan view of the second embodiment of the interlocking jacket with two jackets external to a rectangular concrete column in a first position and the two jackets wrapped around the rectangular concrete column in a second position.
Figure 15:
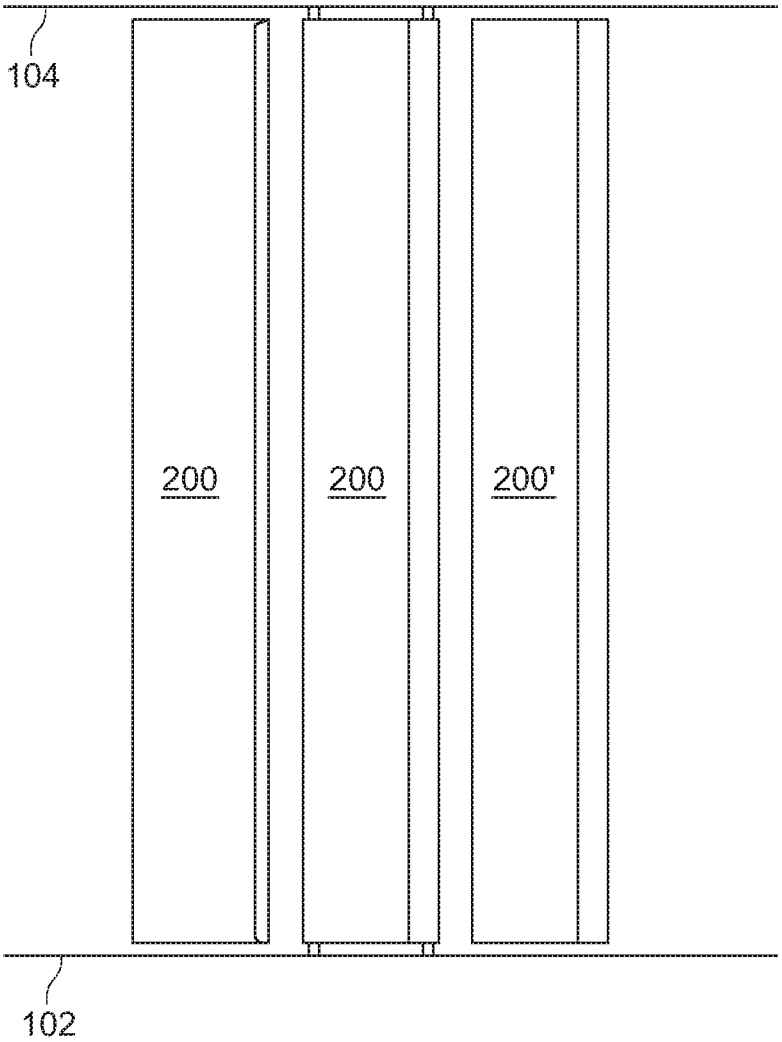
FIG. 15 is a side view of the second embodiment of the interlocking jacket with two jackets external to a rectangular concrete column in a first position and the two jackets wrapped around the rectangular concrete column in a second position.
Figure 16:
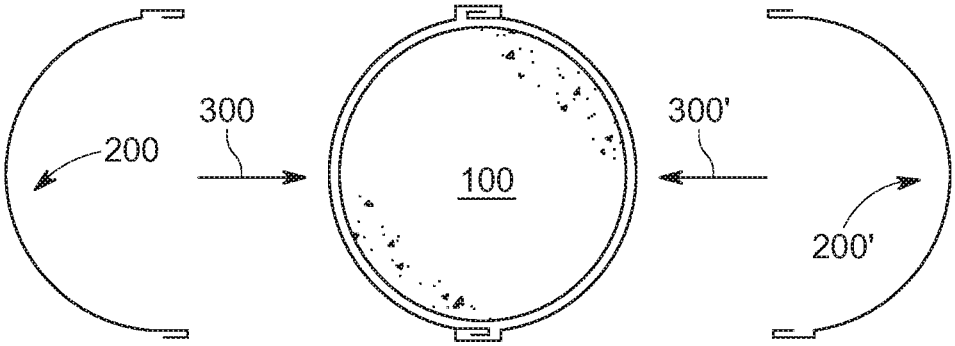
FIG. 16 is a top plan view of the third embodiment of the interlocking jacket with two jackets external to a rectangular concrete column in a first position and the two jackets wrapped around the rectangular concrete column in a second position.
Figure 17:
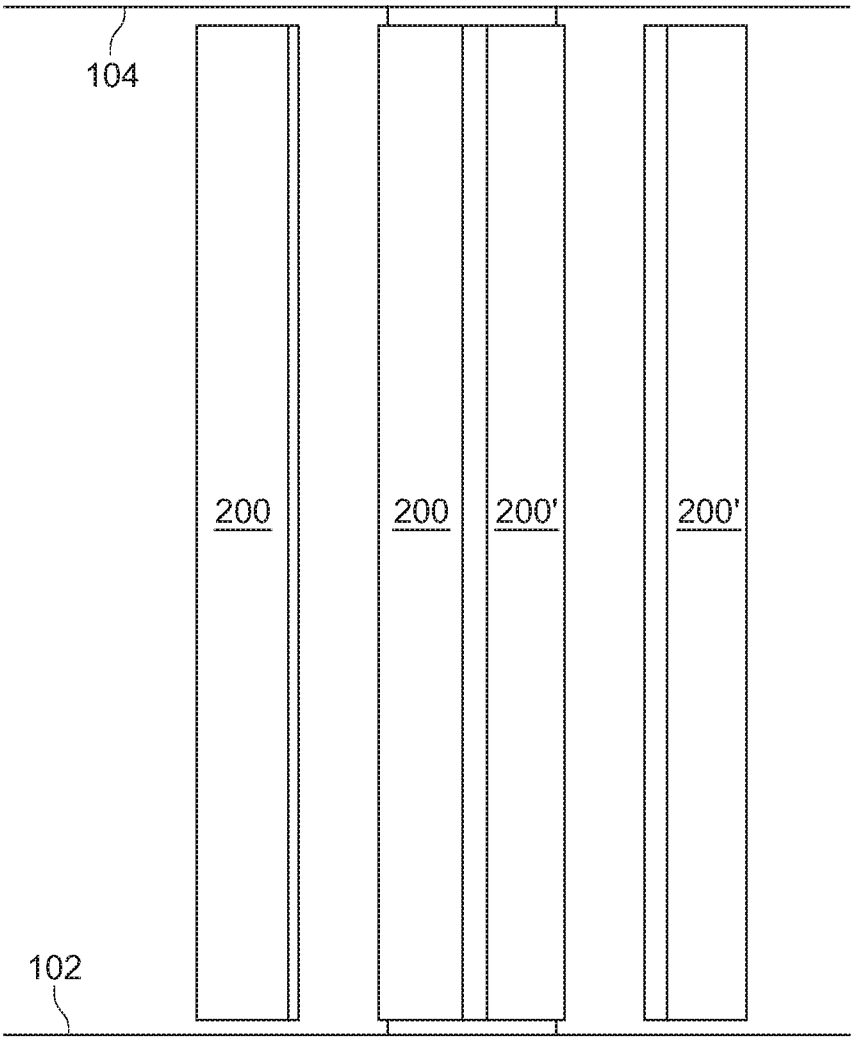
FIG. 17 is a side view of the third embodiment of the interlocking jacket with two jackets external to a rectangular concrete column in a first position and the two jackets wrapped around the rectangular concrete column in a second position.

Referring to FIG. 11, three embodiments of an interlocking jacket 10 is provided. Now referring to FIGS. 1 to 8, FIGS. 1 to 4 represent a first embodiment whereas FIGS. 5 to 8 represent a second embodiment with the second embodiment merely being a 90° rotation of the first embodiment. The jacket 10 includes a first planar member 12 having first 14 and second 16 sides, top 18 and bottom 20 sides and first 22 and second 24 opposed faces. A second planar member 26 is included which also has first 28 and second 30 sides, top 32 and bottom 34 sides and first 36 and second 38 opposed faces. The first 28 side of the second planar member 26 is connected to the first side 14 of the first planar member 12 along substantially the entire length of the first sides and form a substantially a right angle with the first 22 and 36 faces forming an inside angle of the right angle. Preferably, the first 12 and second 26 planar members are rectangular planar members.

The jacket 10 also includes a first hook 40 connected substantially in-line with the first planar member 12 at the second side 16 of the first planar member. The first hook 40 includes a hooking portion 42 substantially parallel with the first planar member 12 and extends along the second face 24 of the first planar member.

The jacket also includes a second hook 44 connected substantially at a right angle with the second planar member 26 at the second side 30 of the second planar member. The second hook 44 also includes a hooking portion 46 substantially parallel with the first planar member 12 and extends towards the first face 36 of the second planar member.

Figure 1:
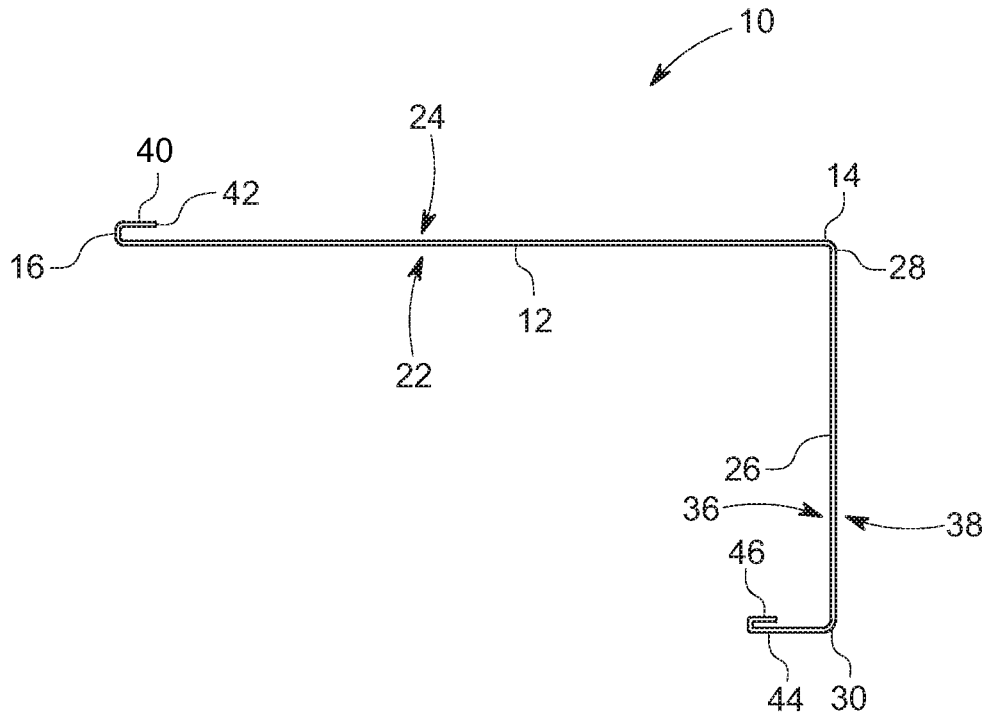
FIG. 1 is top plan view of an interlocking jacket of the invention.
Figure 2:
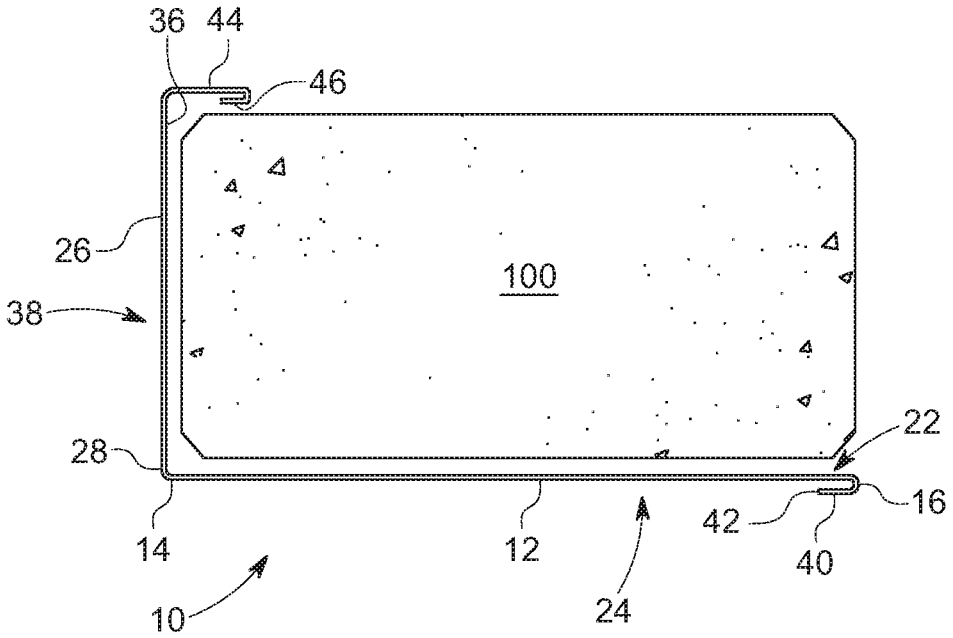
FIG. 2 is a top plan view of the interlocking jacket of FIG. 1 wrapped around a concrete column.
Figure 3:
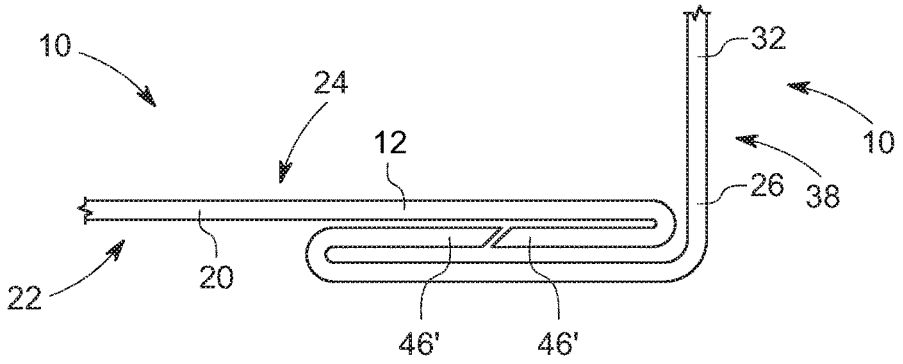
FIG. 3 is a detail of an interlock of two jackets of FIG. 1.
Figure 4:
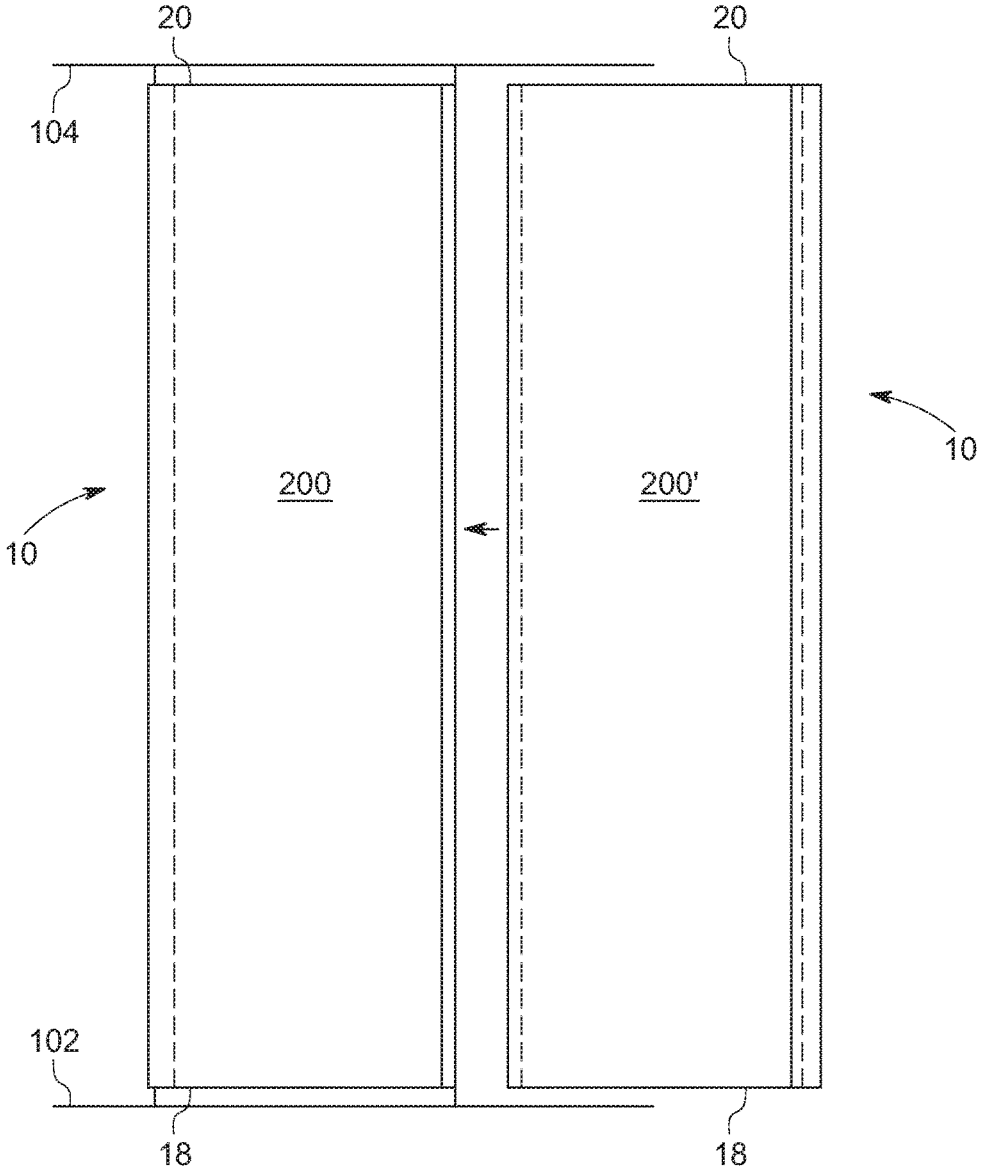
FIG. 4 is a side view of two jackets of FIG. 1 with one jacket wrapped around a rectangular concrete column.
Figure 5:
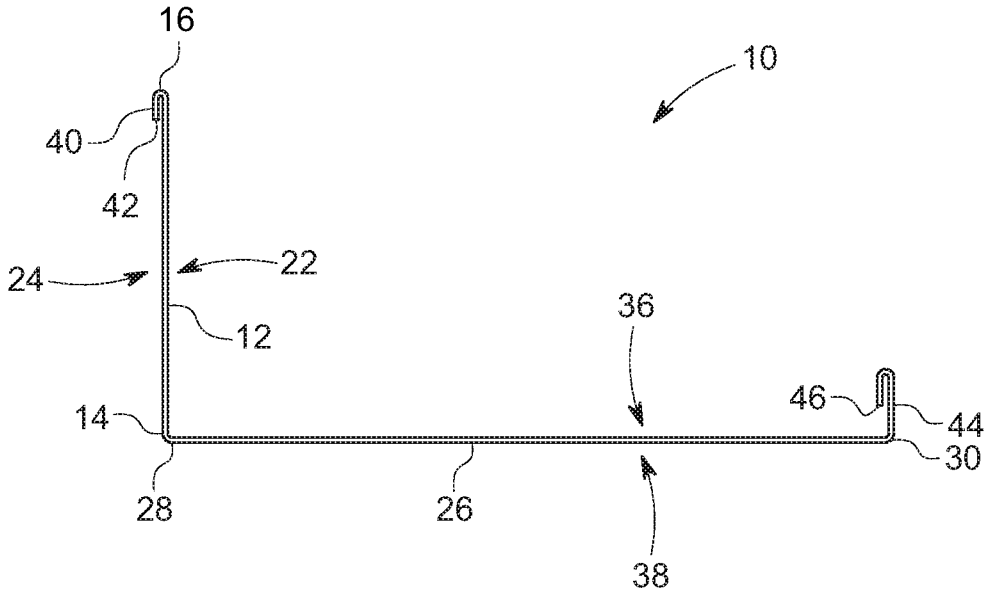
FIG. 5 is top plan view of another embodiment of an interlocking jacket of the invention.
Figure 6:
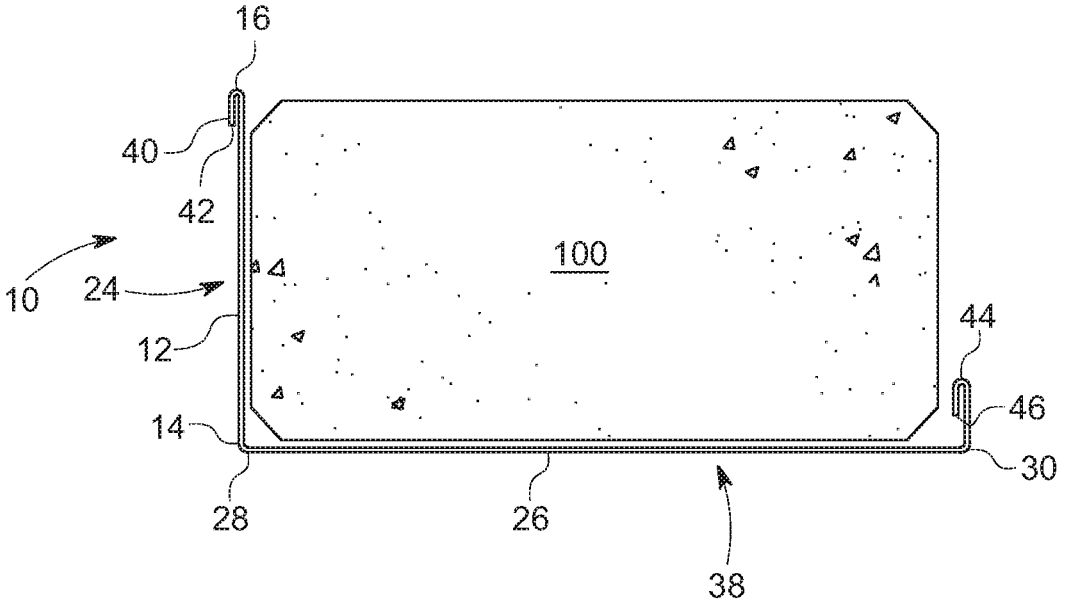
FIG. 6 is a top plan view of the interlocking jacket of FIG. 5 wrapped around a concrete column.
Figure 7:
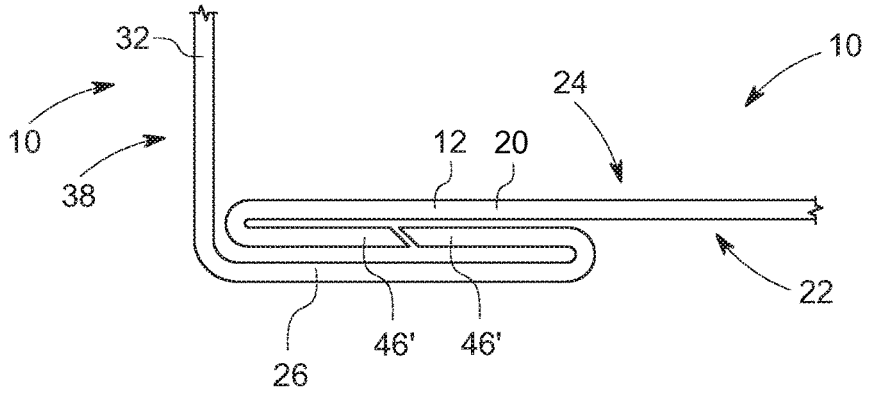
FIG. 7 is a detail of an interlock of two jackets of FIG. 5.
Figure 8:
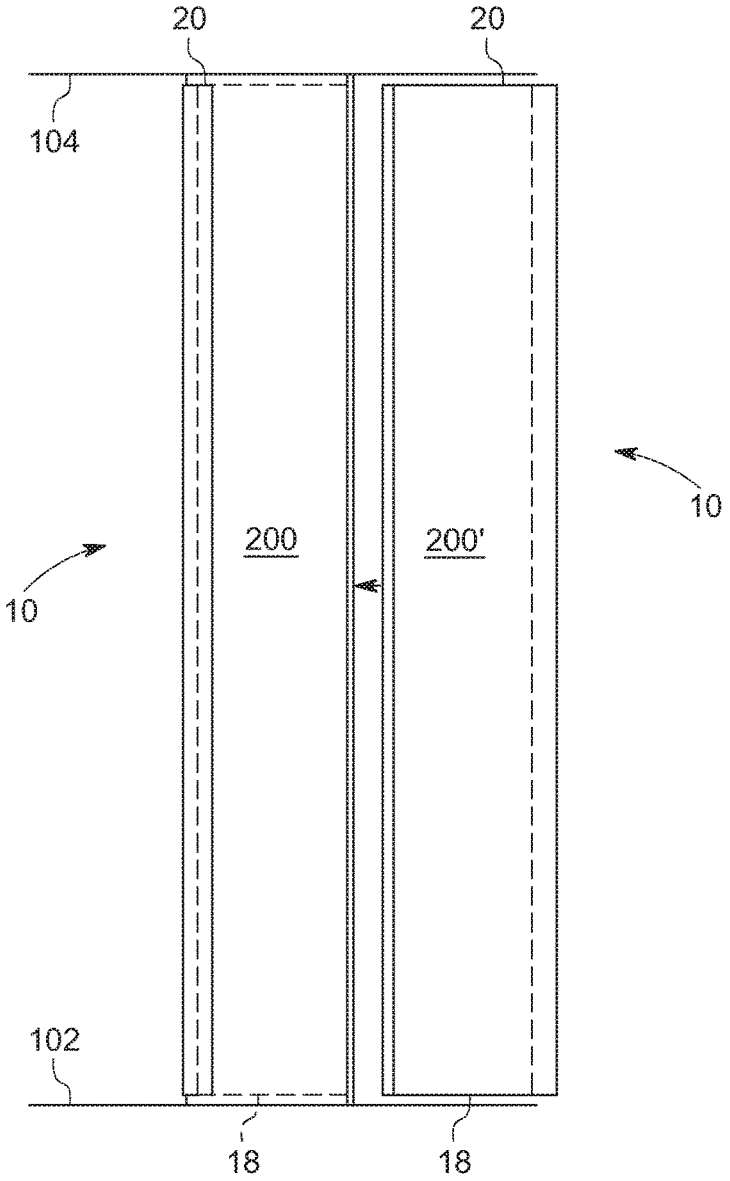
FIG. 8 is a side view of two jackets of FIG. 5 with one jacket wrapped around a rectangular concrete column.
Figure 9:
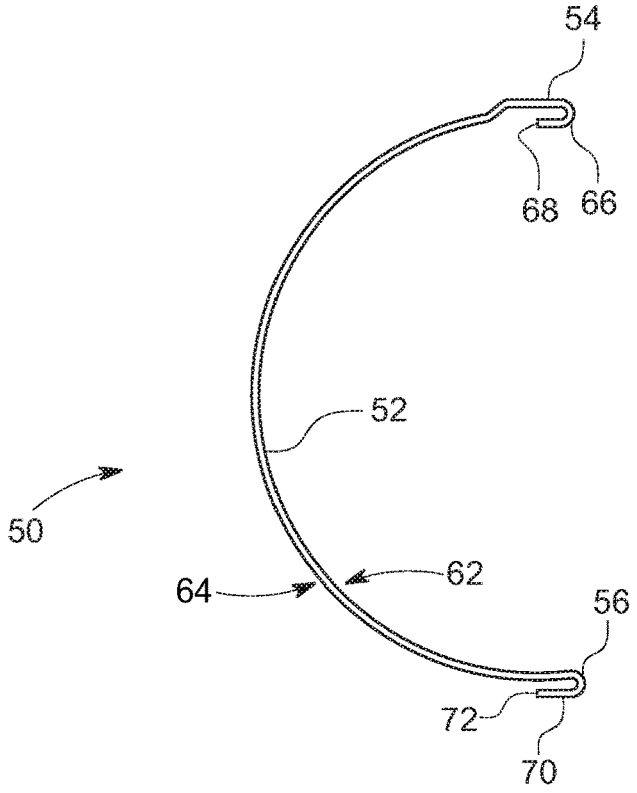
FIG. 9 is top plan view of another embodiment of an interlocking jacket of the invention.
Figure 10:
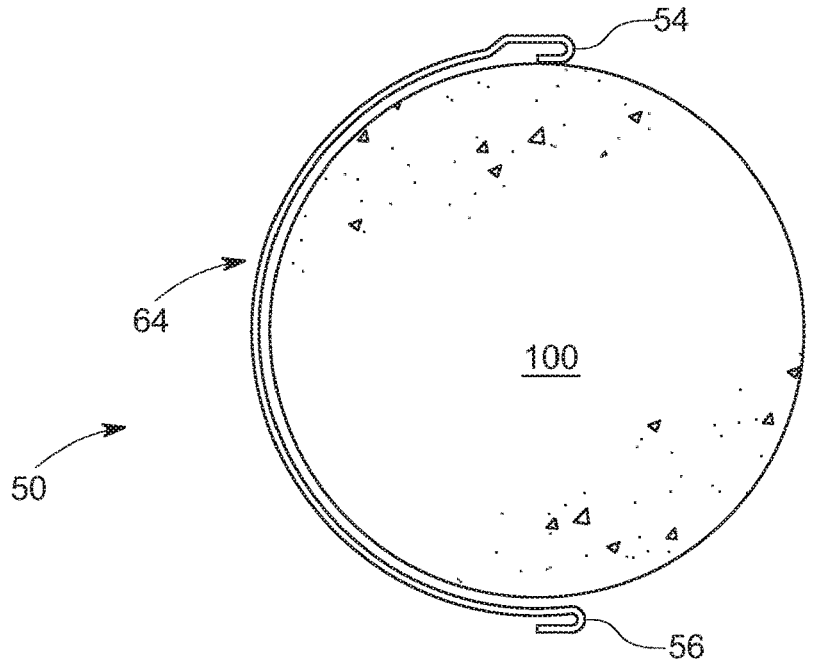
FIG. 10 is a top plan view of the interlocking jacket of FIG. 9 wrapped around a concrete column.

The hook 40 of the first planar member 12 preferably runs substantially the length of the second side 16 of the first planar member whereas the hook 44 of the second planar member 26 runs substantially the length of the second side 30 of the second planar member. As best illustrated in FIGS. 3 and 7, the ends 46 of the hooking portions each comprise a beveled edge at substantially an identical angle, preferably at 45°.

Preferably, the first 12 and second 26 planar members and first 40 and second 44 hooks are integrally formed from a substantially rigid material or they may be integrally formed from substantially a rigid yet flexible material such as ten-gauge stainless steel.

Referring to FIGS. 9 to 12, there is provided another embodiment of an interlocking jacket 50. The jacket 50 includes a planar curved member 52 having first 54 and second 56 sides, top 58 and bottom 60 sides and first 62 and second 64 opposed faces. The jacket 50 also include a first hook 66 connected substantially in-line with the first side 54, the first hook having a hooking portion 68 substantially parallel with the first side and extending along the second face 64 of the curved planar member 52. The jacket 50 also includes a second hook 70 connected substantially in-line with the second side 56, the second hook having a hooking portion 72 substantially parallel with the second side and extending along the first face 62 of the curved planar member 52.

The first hook 66 of the curved planar member 52 runs substantially a length of the first side 54 of the curved planar member whereas the second hook 70 of the curved planar member runs substantially a length of the second side 56 of the curved planar member. The ends 72 of the hooking portions 68 and 72 each comprise a beveled edge at substantially an identical angle, preferably at 45°.

Preferably, the curved planar member 52 and first 66 and second 70 hooks are integrally formed from a substantially rigid material or they may be integrally formed from substantially a rigid yet flexible material such as ten-gauge stainless steel.

As those skilled in the art will appreciate, the dimensions of interlocking jacket 10 may be configured to suit any size of concrete column 100.

Operation

Referring to FIGS. 4, 8, and 12 to 17, typically a structure, such as a concrete pillar 100 runs from the floor 102 to the ceiling 104 of a building (not illustrated) making it impossible to provide jacketing from above or below the concrete pillar. As best illustrated in FIGS. 12 to 17. to provide structure jacketing to an installed and existing pillar 100, a first interlocking jacket 200 as described above is provided and along line 300, is horizontally engaged around the structure. A second interlocking jacket 200' is then provided and is simply rotated on an axis with respect to said first interlocking jacket 200. Second jacket 200' is then along line 300' slidably and horizontally engaged to the structure 100 and with the first interlocking jacket 200 so that the first hook 40 of the first interlocking jacket engages with the second hook 44 of the second interlocking jacket and the second hook of the first interlocking jacket engages with the first hook of the second interlocking jacket. By slidably engaging the interlocking jackets to the structure and to one-another, no tools or fasteners are required as the beveled edges to each end 46 of the hooking portions 40 and 44 engage one-another to provide a mechanical lock.

Figure 18A:
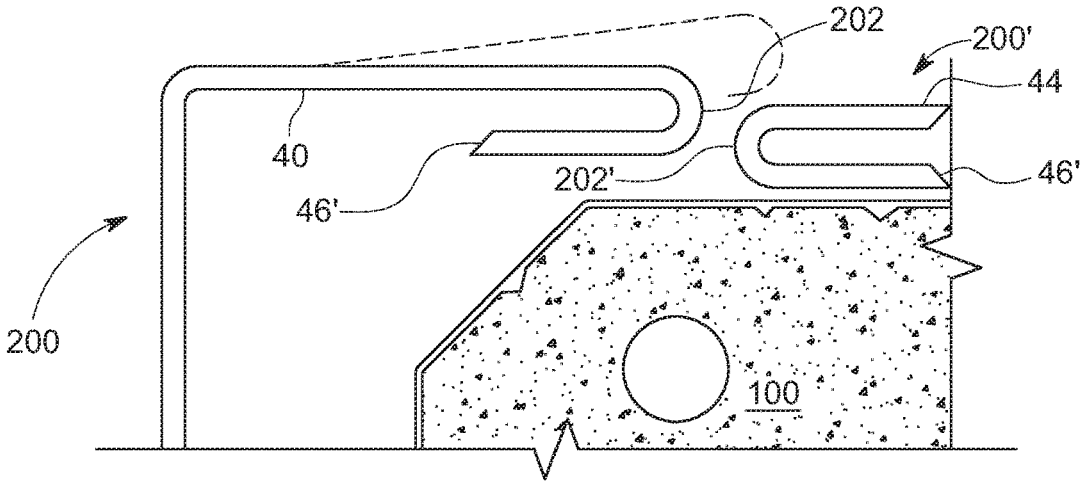
FIG. 18*a* is a partial top plan view of the interlocking hooks of the invention in a pre-engaged position.

Referring to FIG. 18*a* in a pre-engaged position, hooks 40 and 44 of jackets 200 and 200' are disengaged from one another as the jackets are brought together to wrap around the concrete column 100. Advantageously, hooks 40 and 44 have rounded portions 202 and 202' so that when brought together hook 44 of jacket 200' can slide underneath hook 40 of jacket 200. As those skilled in art will appreciate, the reverse is true of the other ends of jackets 200 and 200'. By sliding underneath hook 40, hook 44 deflects hook 40 as shown by the dotted position of hook 40 given that the interlocking jacket may be made of substantially a rigid yet flexible material.

Figure 18B:
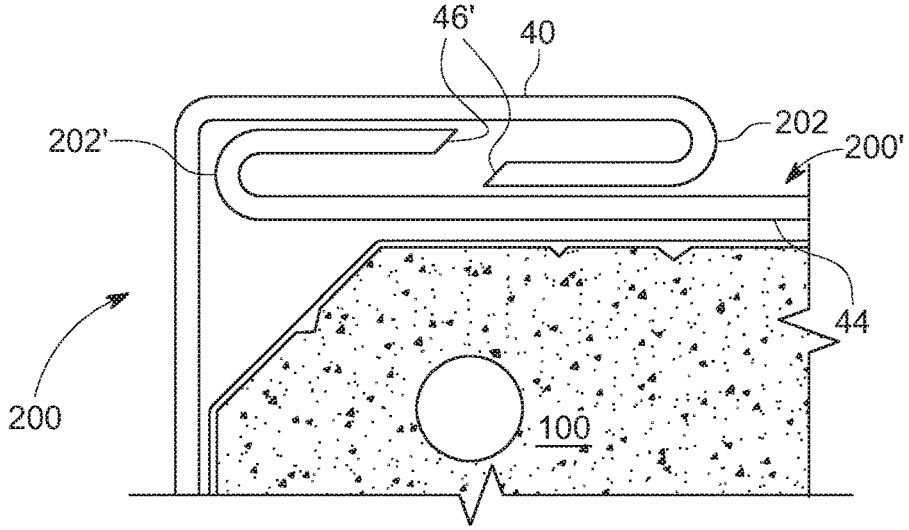
FIG. 18*b* is a partial top plan view of the interlocking hooks of the invention in a semi-engaged position.

Referring to FIG. 18*b* in a pre-engaged position, first hook 44 of jacket 200' has fully slid past second hook 40 of jacket 200. Hooks 40 and 44 are now positioned to begin the engagement process. To begin engagement, jackets 200 and 200' are merely pulled in the opposite direction from one another to look hooks 40 and 44 to one-another.

Figure 18C:
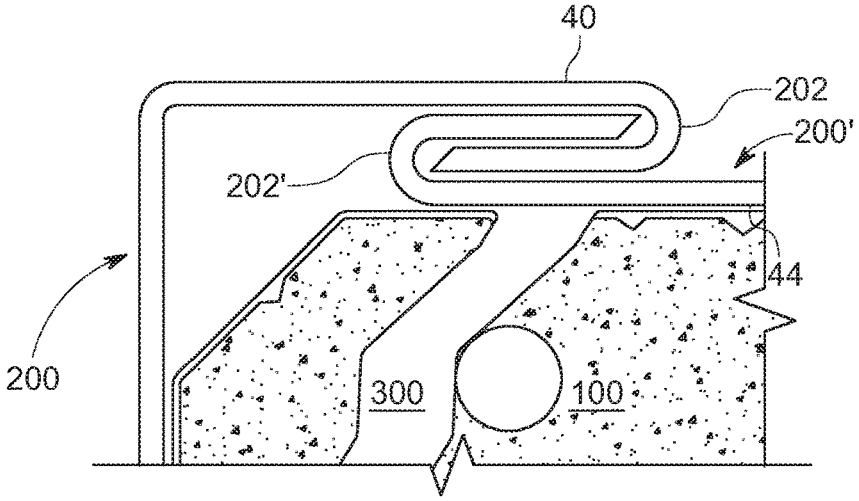
FIG. 18*c* is a partial top plan view of the interlocking hooks of the invention in an engaged position with a concrete column in a buckling state.

Referring to FIG. 18*c*, hooks 40 and 44 are now in an engaged position. Advantageously, ends 46' of hooks 40 and 44 each have beveled edges to facilitate sliding engagement of the hooks to one-another. During an earthquake, column 100 may begin to buckle as shown by area 300. Advantageously, as the column 100 buckles, the buckling forces will pull locking jackets 200 and 200' away from one-another which further engages hooks 40 and 44 into a tight interlocking position. With a tight interlock, jackets 200 and 200' will prevent column 100 from further buckling.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A method of mitigating buckling of a concrete column during an earthquake, comprising:

providing a first interlocking jacket comprising:

a first planar member having first and second sides, top and bottom sides and first and second opposed faces;

a second planar member having first and second sides, top and bottom sides and first and second opposed faces, said first side of said second planar member connected to said first side of said first planar member wherein said first and second planar members form substantially a right angle with said first faces forming an inside angle of said right angle;

a first hook connected substantially in-line with said first planar member at said second side of said first planar member, said first hook having a hooking portion substantially parallel with said first planar member and extending along said second face of said first planar member; and a second hook connected substantially at a right angle with said second planar member at said second side of said second planar member, said second hook having a hooking portion substantially parallel with said first planar member and extending towards said first face of said second planar member;

engaging said first interlocking jacket around the concrete column;

providing a second interlocking jacket comprising:

a first planar member having first and second sides, top and bottom sides and first and second opposed faces;

a second planar member having first and second sides, top and bottom sides and first and second opposed faces, said first side of said second planar member connected to said first side of said first planar member wherein said first and second planar members form substantially a right angle with said first faces forming an inside angle of said right angle;

a first hook connected substantially in-line with said first planar member at said second side of said first planar member, said first hook having a hooking portion substantially parallel with said first planar member and extending along said second face of said first planar member; and a second hook connected substantially at a right angle with said second planar member at said second side of said second planar member, said second hook having a hooking portion substantially parallel with said first planar member and extending towards said first face of said second planar member;

rotating said second interlocking jacket 180° on an axis with respect to said first interlocking jacket; and slidably engaging said second interlocking jacket to the concrete column and with said first interlocking jacket wherein said first hook of said first interlocking jacket engages with said second hook of said second interlocking jacket and wherein said second hook of said first interlocking jacket engages with said first hook of said second interlocking jacket, wherein, when the concrete column buckles during the earthquake, said first and second interlocking jackets pull away from one-another to prevent further buckling of the concrete column by further engaging into a tight interlocking position said first hook of said first interlocking jacket with said second hook of said second interlocking jacket and said second hook of said first interlocking jacket with said first hook of said second interlocking jacket.

2. The method of claim 1 wherein said second interlocking jacket is horizontally engaged to the concrete column and with said first interlocking jacket.

3. The method of claim 1 further comprising providing a beveled edge to each end of said hooking portions.

4. The method of claim 3 wherein slidably engaging said second interlocking jacket to the concrete column and with said first interlocking jacket comprises engaging said hooks with one-another along said beveled edges.

5. A method of mitigating buckling of a concrete column during an earthquake, comprising:

providing a first interlocking jacket comprising:

a curved planar member having first and second sides, top and bottom sides and first and second opposed faces;

a first hook connected substantially in-line with said first side, said first hook having a hooking portion substantially parallel with said first end and extending along said second face of said curved planar member; and a second hook connected substantially in-line with said second side, said second hook having a hooking portion substantially parallel with said second side and extending along said first face of said curved planar member;

engaging said first interlocking jacket around the concrete column;

providing a second interlocking jacket comprising:

a curved planar member having first and second sides, top and bottom sides and first and second opposed faces;

a first hook connected substantially in-line with said first side, said first hook having a hooking portion substantially parallel with said first side and extending along said second face of said curved planar member; and a second hook connected substantially in-line with said second side, said second hook having a hooking portion substantially parallel with said second side and extending along said first face of said curved planar member;

rotating said second interlocking jacket 180° on an axis with respect to said first interlocking jacket; and slidably engaging said second interlocking jacket to the concrete column and with said first interlocking jacket wherein said first hook of said first interlocking jacket engages with said second hook of said second interlocking jacket and wherein said second hook of said first interlocking jacket engages with said first hook of said second interlocking jacket, wherein, when the concrete column buckles during the earthquake, said first and second interlocking jackets pull away from one-another to prevent further buckling of the concrete column by further engaging into a tight interlocking position said first hook of said first interlocking jacket with said second hook of said second interlocking jacket and said second hook of said first interlocking jacket with said first hook of said second interlocking jacket.

6. The method of claim 5 wherein said second interlocking jacket is horizontally engaged to the concrete column and with the first interlocking jacket.

7. The method of claim 5 further comprising providing a beveled edge to each end of said hooking portions.

8. The method of claim 7 wherein slidably engaging said second interlocking jacket to the concrete column and with said first interlocking jacket comprises engaging said hooks with one-another along said beveled edges.

* * * * *